US005369911A

United States Patent [19]

Fortunato

[11] Patent Number: 5,369,911

[45] Date of Patent: Dec. 6, 1994

[54] AUTOMOBILE DOOR OPENING APPARATUS

[76] Inventor: Nick Fortunato, 1037 N. Western Ave., Park Ridge, Ill. 60068

[21] Appl. No.: 121,563

[22] Filed: Sep. 16, 1993

[51] Int. Cl.[5] ..... E05F 15/20

[52] U.S. Cl. ..... 49/25; 49/280; 49/357; 49/379; 70/256

[58] Field of Search ..... 49/25, 379, 339, 340, 49/276, 279, 280, 357; 70/256, 257

[56] References Cited

U.S. PATENT DOCUMENTS

| | | | |
|---|---|---|---|
| 2,116,446 | 5/1938 | Nishimura | 49/280 |
| 2,971,755 | 2/1961 | Green | 49/280 X |
| 3,344,554 | 10/1967 | Misaka et al. | 49/280 |
| 3,398,484 | 8/1968 | Katsumura et al. | 49/280 X |
| 4,183,177 | 1/1980 | Kurdziel | 49/25 |
| 4,644,693 | 2/1987 | Wang | 49/280 |
| 4,663,626 | 5/1987 | Smith | 70/256 X |
| 4,719,460 | 1/1988 | Takeuchi et al. | 70/256 X |
| 4,835,533 | 5/1989 | Akutsu | 70/256 X |
| 4,895,009 | 1/1990 | Kleefeldt et al. | 70/256 X |
| 5,067,277 | 11/1991 | Magalotti | 49/379 X |

*Primary Examiner*—Philip C. Kannan
*Attorney, Agent, or Firm*—Robert J. Black

[57] ABSTRACT

Remote control equipment for remotely opening a vehicle door. A manual operated remote control transmitter transmits a signal to a receiver mounted on the vehicle which causes door mounted motor actuators to unlock and unlatch the door after which a prebiased mechanical door opener functions to open the door wide enough to permit ready access to the vehicle.

8 Claims, 1 Drawing Sheet

AUTOMOBILE DOOR OPENING APPARATUS

BACKGROUND OF THE INVENTION

1. Field of the Invention

The present invention relates to automobile doors and more particularly to a device, which under remote control, unlocks, unlatches and opens an automobile door in response to a remote control signal.

2. Background Art

A search of the background art directed to the subject matter of the present invention conducted in the U.S. Patent and Trademark Office disclosed the following U.S. Letters Patent:

| | |
|---|---|
| 2,094,413 | 4,825,210 |
| 2,665,153 | 4,827,744 |
| 4,183,177 | 4,835,533 |
| 4,663,626 | 4,895,009 |
| 4,719,460 | 5,228,239 |

A thorough review of the above identified patents indicates that none teach, disclose or claim the novel combination of elements and function found in the improved remote control car door opener of the present invention.

Of the above identified patents, only U.S. Pat. Nos. 4,183,177 and 5,228,239 are drawn to systems which under remote control unlock, unlatch and open a vehicle door. However, both structurally and functionally, these substantially differ from the present invention by virtue of utilization of structural arrangements of greater complexity and cost that those found in the present invention.

For safety reasons, it may be highly desirable that an automobile car door can be unlocked and opened so that an approaching driver can swiftly enter the vehicle. This is particularly true at parking garages or similar poorly lighted areas on the street or other locations where thieves, vandals, etc., may be present. Furthermore, most of the systems above identified in the background art are relatively complex and costly, requiring significant modification of an existing automobile for effectiveness.

SUMMARY OF THE INVENTION

The present invention overcomes the disadvantages found in the background art providing a unique remotely controlled system for unlocking, unlatching and opening a vehicle or similar apparatus. More particularly, the system of the present invention utilizes the elements and function of the conventional power door locking system as found in most vehicles today. By the addition of only a minimum number of components (including a transmitter, receiver, simple motor actuator and a diode, and a prebiased mechanical actuator), implementation of the present invention is achieved.

In the usual vehicle equipped with power door locks, common equipment is found usually in each door so equipped. A manually operated non-locking switch for locking and unlocking the door, a pair of relays each equipped with a break/make spring combination, a door lock/unlock motor actuator. In the usual arrangement, by means of operation of the manually operable lock-/unlock switch, power from the car (12 volts DC) is applied to one or the other of the two relays. Depending on the desired operation, lock or unlock relays (as they will be described hereinafter) will cause the associated motor actuator to mechanically operate the door locking mechanism to its locked or unlocked position as selected.

As may be readily seen and also as available in the background art, a combination of a receiver able to receive signals from a remotely located transmitter can function to provide, in response to a received signal from the transmitter, a DC output to operate the unlocking relay to operate the associated lock/unlock motor actuator to release the door lock.

As may be seen from the foregoing, operation of the remote control transmitter and receipt of a signal from its receiver can effectively, with existing structures in a power door lock equipped automobile, unlock the door. However, it remains at this time for the user to approach the automobile, pressing the door latch manually to release the door latch after which the user must grip the door handle and manually open the vehicle door.

The problem is solved by installing a motor (similar to the door lock/unlock motor) in the door and connecting it to the latch mechanism. An input signal received from the remote control transmitter by the receiver will, in addition to operating the lock/unlock motor (causing the locking mechanism to open), also function to trigger the latch mechanism internally, whereby the car door is both unlocked and unlatched. At this time, in response to the unlatching, an included mechanical prebiased door opener element functions to force the door to an open position in order that the vehicle may be easily accessed by the operator of the remote control transmitter.

In most remote control arrangements like that taught here, it has been found convenient to utilize small radio frequency transmitters operated by means of a single switch, by the user. An associated radio frequency receiver located in the automobile is able to receive the signals transmitted from the remote control transmitter. However, it should be also understood that other means of signal transmission and reception could also be utilized, such as the use of light signals, with both visible and invisible light being effective, as well as sound wave transmitters and receivers of the sonic and ultrasonic types.

The inclusion of a simple diode in the system, coupled between the receiver and the unlatching relay, insures that should the unlocking relay be operated from the manually operated internal unlocking switch, the DC potential is not extended through to the unlatching motor, so that the latch release motor actuator is only operated in response to a signal from the remote control transmitter received by the remote control receiver functioning as a part of the present invention.

DESCRIPTION OF THE PREFERRED EMBODIMENT

Figure 1:
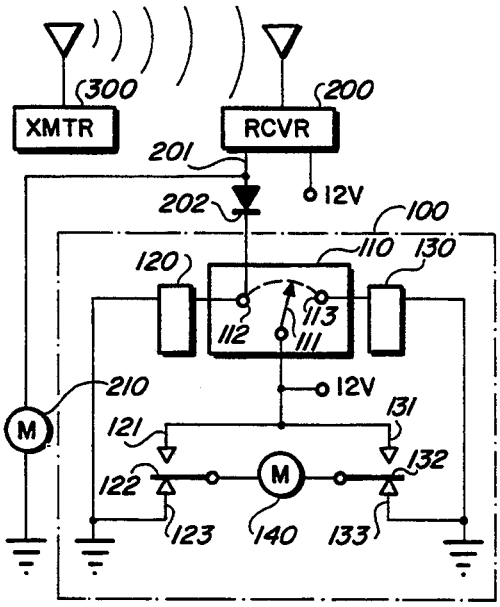
FIG. 1 is a schematic diagram of an automobile car door opening apparatus in accordance with the present invention.

Referring now to FIG. 1, the circuit of the automobile door opener of the present invention is shown schematically. That portion of the equipment that is part of the usual power lock arrangement is shown in block 100. Contained therein is the non-locking manually operable lock and unlock door switch 110. Connected to the wiper 111 of door lock switch 110 is a 12 volt DC battery source. Contact 112, the unlock contact, provides a path from the 12 volt DC source through the wiper 111 and contact 112 to unlocking relay 120. Associated with unlocking relay 120 is a make/break spring combination consisting of armature 122, make contact 121, and break contact 123. Contact 123 and one coil portion of relay 120 include connections to ground. Also, as may be seen within standard equipment block 100 is locking relay 130 which receives potential from the 12 volt DC source through wiper 111 and contact 113. Locking relay 130 has associated therewith a make/break spring combination consisting of armature 132, make spring contact 131 and break contact 133. Break contact 133 and the coil of relay 130 are connected to ground. The armatures 122 and 132 of relays 120 and 130, respectively, are both connected to the lock/unlock motor actuator 140, which is part of the original car equipment.

As may be seen from the foregoing, assuming the occupant wishes to lock the doors, he would operate power door lock manual switch 110 sending 12 volt DC potential through wiper 111 and contact 113 through to locking relay 130. Locking relay 130, by virtue of the application of 12 volt DC potential thereto, will cause armature 132 to move towards coil 130 making contact with make contact 131. Thus, DC potential, which is connected to relay contact 131 is applied to lock/unlock motor actuator 140, the other side of which is connect to ground through armature 122 and break contact 123. Thus, in response to actuation of motor actuator 140, the actual door lock, which is connected thereto in a well known manner, operates to the lock position, locking the automobile door. Since, switch 110 was non-locking, 12 volt DC potential will be removed from relay 130 and thus armature contact 132 will return to its normal position against break contact 133, which is connected to ground, causing motor actuator 140 to cease operation. However, at this time the door locking mechanism will remain in the locked position after it has been moved to that location.

Should the operator now desire to unlock the door mechanism, he would then again operate non-locking switch 110 to an unlock position, making contact between wiper 111 and contact 112. Thus, 12 volt DC is extended to unlocking relay 120, which will operate its associated contacts, causing 12 volt DC potential to be applied through make contact 121 and armature 122 to lock/unlock actuator motor 140. Actuator motor 140 will now operate in the opposite direction from that previously operated, causing the connected and associated lock/unlock door lock to become unlocked.

Signal receiver 200, which as indicated previously may receive radio frequency signals, light signals or sound signals in response to receipt of a signal of the appropriate kind from transmitter 300 usually operated at some distance remote from the vehicle, will cause a 12 volt DC output to appear on lead 201. Via lead 201, 12 volt DC potential is applied through diode 202 to unlocking relay 120. In a manner similar to that described for manual operation, DC potential is applied through contact 112 to relay 120, to cause relay 120 to operate connecting 12 volt DC through make contact 111 and armature 122 to unlocking motor actuator 140, the other side of which is connected through break contact 133 and armature 132 to ground, thus unlocking the door lock should it be in the locked position as previously described. However, at the same time, application of 12 volt DC on lead 201 also extends that potential to door latch release motor actuator 210, which mechanically operates the car door latch connected thereto, so as to unlatch the vehicle door. At this time, the car door has been unlocked and unlatched, so that the car door opener prebiased mechanical element 220 as shown in the exploded form in FIG. 2 and installed as shown in FIG. 3 operates, causing the compressed spring 222 thereon to expand, moving the piston 221 in such a direction as to force the car door to the open position. It has been determined that by means of the prebiased mechanical piston mechanism 220 as taught by the present invention the door can be forced to an open position of at least 10–14 inches.

When the car door is closed, piston 221, under action of the door, is forced down through the piston bearing 223 in a retracted position inside the automobile frame.

Figure 2:
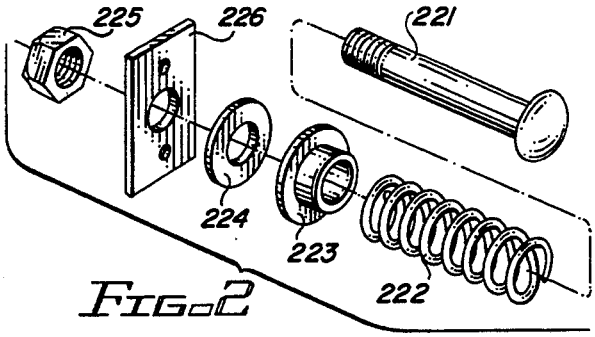
FIG. 2 is an exploded view of a prebiased mechanical door opener in accordance with the present invention.
Figure 3:
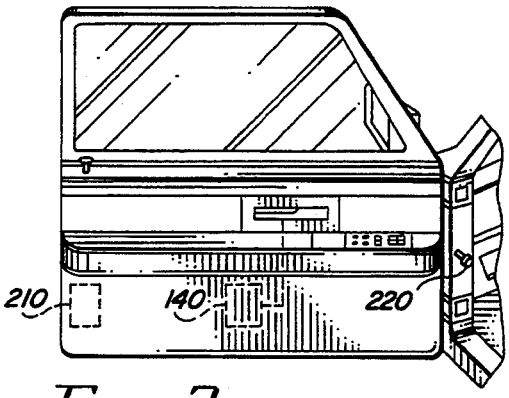
FIG. 3 is a drawing showing the installation of the mechanical car door opener of FIG. 2 shown in position between a car door and the car body frame.
Figure 4:
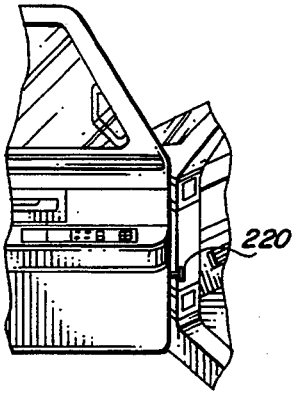

Referring to FIG. 2, the form of the prebiased mechanical car door opener consists of a piston 221 placed within a compression spring 222 with an associated bearing 223 and 225 nut securing the unit to the car body frame. A mounting plate 226 and washer 224 may also be utilized to securely fasten this element to the car body, if desired.

Figure 5:
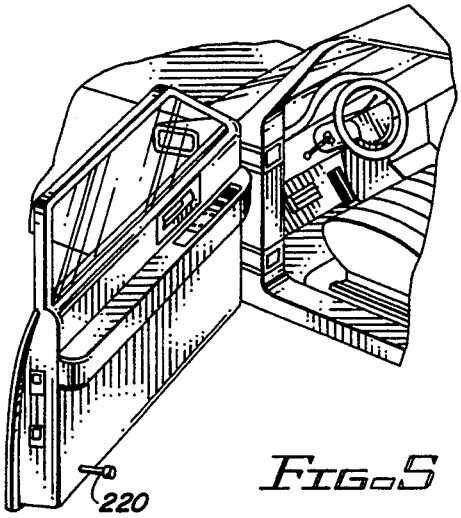
FIG. 4, 5, 6 and 7 show placements of pressurized gas cylinders as alternate car door openers in various vehicle locations.
Figure 7:
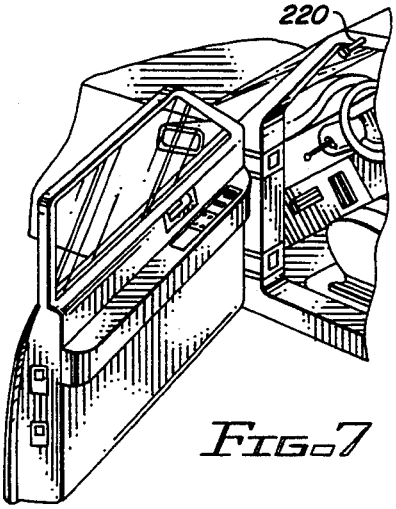
Figure 6:
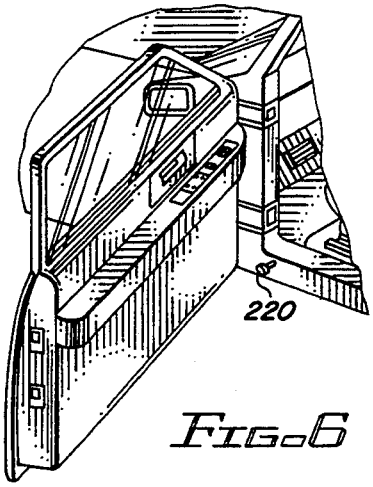
Figure 8:
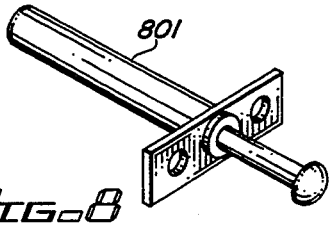
FIG. 8 is a perspective view of a gas cylinder as utilized for a door opener in accordance with the present invention.

As has been shown in FIG. 3, a convenient location for this is to place this prebiased mechanical element between the car body frame and the car door itself. Actually, it could be mounted in the car body frame, pressing against the door, or vice versa, mounted within the door pressing against the frame. The actual pressing being done by the round head on piston 221. Instead of the prebiased mechanical structure shown in FIG. 3, it is also possible to use a pressurized gas cylinder, or a cylinder with a compression spring and piston, as alternate mechanical structures. In addition to the location shown, it is possible to mount such units within the car door with the head pressing against the car frame as shown in FIG. 5. Alternately, as seen in FIG. 8 use of a similar pressurized gas cylinder 801 to provide the necessary prebiased operational mechanism in a location similar to that shown in FIG. 3. Pressurized gas cylinders could also be utilized as shown in FIGS. 6 and 7, where it will be obvious to those skilled in the art that numerous approaches could be utilized, including a rotating drive screw which would necessitate the inclusion of some drive mechanism therefor.

It will be obvious to those skilled in the art that numerous modifications of the present can be made without departing from the spirit of the present invention, which shall be limited only by the scope of the claims appended hereto.

What is claimed is:

1. Door opening means for remotely operation at least one closed passenger door of a vehicle equipped with power door locks, said door including a lock, a latch, first and second relays, each of said relays including a coil, an armature, a make contact connected to DC power of a first polarity, and a break contact connected to DC power of a second polarity, a first actuator connected to said lock and including circuit connections to said first and second relay armatures, a non-locking switch including a first contact connected to said first relay coil, a second contact connected to said second relay coil, and a wiper connected to DC power of said first polarity, said switch manually operated to connect said DC power of said first polarity via said wiper through said first contact to said first relay coil to operate said first relay to connect said DC power of said first polarity via said first relay make contact and said first relay armature to said first actuator, to operate said first actuator to a first position to lock said lock, said switch manually operated to a second position to connect said DC power of said first polarity via said wiper to said second contact to said second relay coil to operate said second relay, said second relay in response to operation connecting said DC power of said first polarity, via said second relay make contact and said second relay armature to said first actuator to operate said first actuator to a second position to unlock said lock, the improvement comprising:

second actuator means coupled to said latch;

a remote control receiver including a connection to said DC power of said first polarity and output circuit connections to said second relay coil and to said second actuator means;

unidirectional conducting means included in said circuit connection between said receiver and said second relay coil;

said unidirectional conducting means operated to inhibit operation of said second actuator means in response to the manual operation of said switch to operate said second relay;

a remote control transmitter manually operated to transmit an operating signal to said receiver;

said receiver operated in response to said signal to connect DC power of said first polarity over said circuit connections to said second relay coil and to said second actuator;

said second relay in response to said DC power of said first polarity operated to connect DC power of said first polarity via said second relay make contact and armature to said first actuator to render said first actuator means operated to unlock said lock, said second actuator operated in response to said DC power of said first polarity received from said receiver, to unlatch said latch;

and a door opener comprising prebiased mechanical means in contact with said closed door operated in response to both the unlocking of said lock and the unlatching of said latch to open said door.

2. Door opening means as claimed in claim 1 wherein: said transmitter transmits radio frequency signals to said receiver to render said receiver operated.

3. Door opening means as claimed in claim 1 wherein: said transmitter transmits optical frequency signals to said receiver to render said receiver operated.

4. Door opening means as claimed in claim 1 wherein: said transmitter transmits sonic frequency signals to said receiver to render said receiver operated.

5. Door opening means as claimed in claim 1 wherein: said door opener comprises a spring loaded piston.

6. Door opening means as claimed in claim 1 wherein: said door opener comprises a pressurized gas cylinder including a piston.

7. Door opening means as claimed in claim 1 wherein: said door opener is mounted on said vehicle normally in contact with said door when said door is closed.

8. Door opening means as claimed in claim 1 wherein: said door opener is mounted on said door normally in contact with said vehicle when said door is closed.

* * * * *